US010662539B2

(12) United States Patent
Baxter

(10) Patent No.: US 10,662,539 B2
(45) Date of Patent: May 26, 2020

(54) SYSTEMS AND METHODS FOR CONTROLLING HEAT LOSS FROM AN ELECTROLYTIC CELL

(71) Applicant: Bechtel Mining & Metals, Inc., Houston, TX (US)

(72) Inventor: Robert F. Baxter, Kingston (CA)

(73) Assignee: Bechtel Mining and Metals, Inc., Houston, TX (US)

( * ) Notice: Subject to any disclaimer, the term of this patent is extended or adjusted under 35 U.S.C. 154(b) by 167 days.

(21) Appl. No.: 15/745,832

(22) PCT Filed: Sep. 29, 2017

(86) PCT No.: PCT/US2017/054265
§ 371 (c)(1),
(2) Date: Jan. 18, 2018

(87) PCT Pub. No.: WO2019/066890
PCT Pub. Date: Apr. 4, 2019

(65) Prior Publication Data

US 2019/0360114 A1 Nov. 28, 2019

(51) Int. Cl.

| | |
|---|---|
| ***C25C 3/20*** | (2006.01) |
| ***C25C 3/08*** | (2006.01) |
| ***C25C 3/22*** | (2006.01) |

(52) U.S. Cl.
CPC ..... *C25C 3/20* (2013.01); *C25C 3/085* (2013.01); *C25C 3/22* (2013.01)

(58) Field of Classification Search
CPC ..... C25C 3/06–3/24
See application file for complete search history.

(56) References Cited

U.S. PATENT DOCUMENTS

| | | | | |
|---|---|---|---|---|
| 4,608,135 | A | 8/1986 | Brown | |
| 5,208,115 | A * | 5/1993 | Akagi | H01M 8/04029 429/437 |
| 6,251,237 | B1 | 6/2001 | Bos et al. | |
| 7,527,715 | B2 | 5/2009 | Fiot et al. | |
| 7,901,617 | B2 | 3/2011 | Taylor et al. | |
| 9,234,704 | B2 | 1/2016 | Taylor et al. | |
| 2006/0254925 | A1 | 11/2006 | Slaugenhaupt et al. | |
| 2008/0020265 | A1 | 1/2008 | Liu et al. | |
| 2009/0068516 | A1* | 3/2009 | Kawai | H01M 8/04067 429/442 |
| 2009/0183858 | A1 | 7/2009 | Williams et al. | |
| 2016/0365612 | A1 | 12/2016 | Bradwell et al. | |

OTHER PUBLICATIONS

Lee W. Young; International Search Report and Written Opinion for PCT Application No. PCT/US17/54265; dated Dec. 12, 2017; 12 pages; USPTO as ISA; Alexandria, Virginia.

(Continued)

*Primary Examiner* — Ciel P Thomas
*Assistant Examiner* — Ciel P Contreras
(74) *Attorney, Agent, or Firm* — Crain, Caton and James

(57) ABSTRACT

Systems and methods for controlling heat loss from an electrolytic cell in a smelting process using an adjustable fluid passage to control the heat loss from a preferred area of the electrolytic cell side walls based on operating conditions in the electrolytic cell, and to direct the waste heat from the electrolytic cell side walls back into the electrolytic cell.

15 Claims, 6 Drawing Sheets

(56) References Cited

OTHER PUBLICATIONS

Mark P. Taylor and John J.J. Chen, Technique for Low Amperage Potline Operation for Electricity Grid Storage, Metallurgical and Materials Transactions E, Feb. 21, 2015, 12 pages, vol. 2 E, Light Metals Research Centre, University of Auckland, Private Bag 92019, New Zealand.

S. Namboothiri, P. Lavoie, D. Cotton, and M.P. Taylor, Controlled cooling of aluminum smelting cell sidewalls using heat exchangers supplied with air, Light Metals 2009, 6 pages, Light Metals Research Centre, University of Auckland, Private Bag 92019, New Zealand.

Eng. Abdullah I Al-Khatteb, Examination Report, Application No. GC 2018-36065, dated Dec. 31, 2019, 4 pages, GCC Patent Office, Saudi Arabia.

* cited by examiner

SYSTEMS AND METHODS FOR CONTROLLING HEAT LOSS FROM AN ELECTROLYTIC CELL

CROSS-REFERENCE TO RELATED APPLICATIONS

This application is a U.S. National Stage Application of PCT Patent Application Ser. No. PCT/US17/54265, filed on Sep. 29, 2017, which is incorporated herein by reference. PCT Patent Application Serial No. PCT/US17/54265 and PCT Patent Application Serial No. PCT/US14/41485, which is also incorporated herein by reference, are commonly assigned to Bechtel Mining & Metals, Inc.

FIELD OF THE DISCLOSURE

The present disclosure generally relates to systems and methods for controlling heat loss from an electrolytic cell. More particularly, the present disclosure relates to controlling heat loss from an electrolytic cell in a smelting process using an adjustable fluid passage to control the heat loss from a preferred area of the electrolytic cell side walls based on operating conditions in the electrolytic cell, and to direct the waste heat from the electrolytic cell side walls back into the electrolytic cell.

BACKGROUND

Aluminum metal is produced industrially by electrolysis of smelter grade (or other) alumina in a molten electrolyte using the well-known Hall-Héroult process. This process may be referred to herein generally as a smelting process. The electrolyte is contained in a pot comprising a steel pot shell, which is coated on the inside with refractory and insulating materials, and a cathodic assembly located at the bottom. Carbon anodes extend into the electrolyte, which comprises molten cryolyte and dissolved alumina. A direct current, which may reach values of more than 500 kA, flows through the anodes and the electrolyte to generate chemical reactions that reduce the alumina to an aluminum metal, and that heat the electrolyte by the Joule effect to a temperature of approximately 960° C. Emissions from the electrolytic cell comprise a number of gaseous and particulate constituents, also referred to as process gases, such as hydrogen fluoride (Fg) and particulate fluoride (Fp).

Dry adsorption and chemisorption of gaseous fluorides onto the surface of fresh alumina, followed by the recycle of the fluorinated alumina back to the electrolytic cell as the feed material for an aluminum smelting process, is widely accepted as the best available technique for abating fluoride emissions from an electrolytic cell. An injection type dry scrubbing system uses adsorption followed by chemisorption of gaseous hydrogen fluoride onto the surface of smelter grade alumina, and then filters the alumina and particulate before releasing scrubbed gases (including residual emissions) to the environment. Depending on the electrolytic cell operating current and operating conditions (i.e. ventilation rate, electrical resistance, which varies with the anode to cathode distance (ACD), and electrolysis current), the temperature of the process gases exhausted from conventional electrolytic cells typically varies between 100° C. to 140° C. above ambient temperature. Because the temperature of the process gas exhausted from the electrolytic cell varies indirectly with the moist ambient air flow entering the electrolytic cell, conventional smelting process systems with significantly reduced ventilation flow can theoretically generate process gas temperatures up to about 400° C.

The conventional smelting process is inherently inefficient with an energy to metal conversion efficiency of just 50%. The balance of the energy is lost to the environment in the form of low grade waste heat. Because the current amperage in an electrolytic cell has and will continue to exceed 500 kA, the energy released to the process gases has and will continue to increase the process gas exhaust temperature. The adsorption efficiency of gaseous fluoride on the surface of the alumina will thus, be reduced if suitable countermeasures to cool the process gases are not implemented by conventional injection type dry scrubbing systems.

The electrolytic cell is generally controlled to maintain a preferred thermal equilibrium—meaning heat dissipated by the electrolytic cell is balanced by the heat produced in the cell. The point of a preferred thermal equilibrium is that which achieves the most favorable operating conditions in not only technical, but economic terms. Maintaining an optimal electrolyte temperature, for example, represents an appreciable saving on the production cost of aluminum due to the reduced energy consumption by the electrolytic cell. Maintaining the preferred thermal equilibrium depends largely on the physical design parameters of the electrolytic cell such as the dimensions and properties of the cathode side wall lining, the cover material (crust) granulometry/thickness, and the operating conditions (e.g. electrolysis current). The electrolysis current amperage may be modulated, for example, under different operating conditions depending on the electrical grid supply and demand. Modulating the current has a direct effect on the heat flux along the electrolytic cell sidewalls, which varies along the vertical surface. Peak heat flux typically occurs at the molten electrolyte—molten metal interface where the electrical ohmic resistance (and resulting heat generation) is greatest between the anodes and cathode bars. Maintaining the preferred thermal equilibrium therefore, also depends on the ability to control heat loss from a preferred area of the electrolytic cell side walls during different current amperages in the electrolytic cell.

Current technology to control heat loss from the electrolytic cell includes heat exchangers and forced cooling systems, which use fixed, non-adjustable, elements such as nozzles and heat exchangers to enhance cooling of the electrolytic cell side walls. These technologies are capable of modulating (increasing or decreasing) the total heat loss from the side walls as the current amperage flowing through the electrolytic cell is modulated upward when relatively low-cost power is available from an electrical grid and downward to conserve power during periods of peak demand on an electrical grid. These technologies, however, are not capable of adjusting modulated cooling within a preferred area of the electrolytic cell side walls based on operating conditions in the electrolytic cell. In addition, these technologies direct the waste heat away from the electrolytic cell into the pot-room where the energy is lost to the environment in the form of low grade waste heat. As a result, these technologies can expose operating personnel to dissipated heat and entrained dust.

BRIEF DESCRIPTION OF THE DRAWINGS

The present disclosure is described below with reference to the accompanying drawings in which like elements are referenced with like reference numerals, and in which.

DETAILED DESCRIPTION OF THE ILLUSTRATIVE EMBODIMENTS

Figure 1:
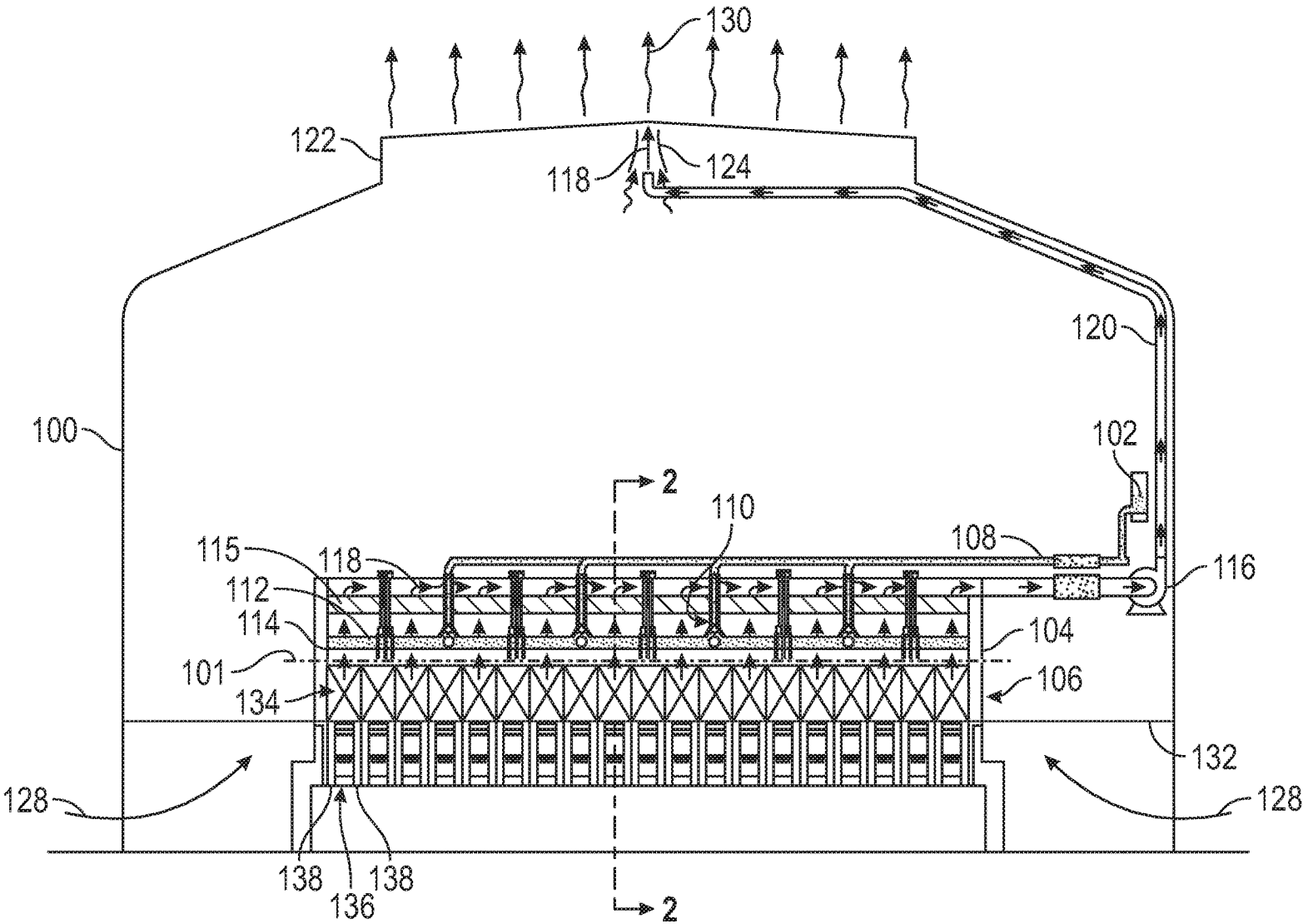
FIG. 1 is a schematic, partial cross-sectional view of a pot-room and electrolytic cell in a smelting process system illustrating one embodiment of an adjustable fluid passage according to the present disclosure.

The subject matter of the present disclosure is described with specificity; however, the description itself is not intended to limit the scope of the disclosure. The subject matter thus, might also be embodied in other ways, to include different structures, steps and/or combinations similar to and/or fewer than those described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. Other features and advantages of the disclosed embodiments will be or will become apparent to one of ordinary skill in the art upon examination of the following figures and detailed description. It is intended that all such features and advantages be included within the scope of the disclosed embodiments. Further, the illustrated figures are only exemplary and are not intended to assert or imply any limitation with regard to the environment, architecture, design, or process in which different embodiments may be implemented. Thus, while the following description refers to the aluminum smelting industry, the systems and methods described herein are not limited thereto and may also be applied in other industries and processes to control heat loss. To the extent that temperatures and pressures are referenced in the following description, those conditions are merely illustrative and are not meant to limit the disclosure.

The present disclosure overcomes one or more of the prior art disadvantages by controlling heat loss from an electrolytic cell in a smelting process using an adjustable fluid passage to control the heat loss from a preferred area of the electrolytic cell side walls based on operating conditions in the electrolytic cell, and to direct the waste heat from the electrolytic cell side walls back into the electrolytic cell.

In one embodiment, the present disclosure includes a system for controlling heat loss from an electrolytic cell, which comprises: i) a pair of frames supporting the electrolytic cell; ii) a flexible member secured between the pair of frames; iii) an adjustable fluid passage formed between the flexible member, a portion of the pair of frames and a portion of a side wall of the electrolytic cell, wherein the fluid passage includes a choke section with an adjustable length and an adjustable gap and one end of the fluid passage is open to ambient air outside the electrolytic cell and another end of the fluid passage is open to process gases inside the electrolytic cell; and iv) a biasing assembly secured between the pair of frames outside the fluid passage and in contact with the flexible member.

In another embodiment, the present disclosure includes a method for controlling heat loss from an electrolytic cell, which comprises: i) inducting ambient air from outside the electrolytic cell into an adjustable fluid passage formed between a flexible member, a portion of a side wall of the electrolytic cell, and a portion of a pair of frames supporting the electrolytic cell; ii) controlling heat loss from the electrolytic cell by transferring heat from the portion of the electrolytic cell side wall to the ambient air in the fluid passage; and iii) inducting the heated ambient air from the fluid passage into the electrolytic cell.

Referring now to FIG. 1, a schematic, partial cross-sectional view of a pot-room 100 in a smelting process illustrates one embodiment of an adjustable fluid passage according to the present disclosure. Line 101 divides an electrolytic cell 106 between its superstructure 104 (shown in cross section) and its lower half (shown in full), which is also referred to as a pot shell. Fresh (non-fluorinated) alumina 102 is delivered directly to the superstructure 104 for the electrolytic cell 106 by a fresh alumina conveyor 108 where it enters a fresh alumina feeder assembly 110. The fresh alumina feeder assembly 110 delivers fresh alumina 102 to a fluidized bed 112, which includes a porous floor 114 that permits gaseous and particulate fluoride from process gases formed below to pass through it while supporting the fresh alumina 102. The gaseous and particulate fluoride from the process gases formed below pass through the porous floor 114 and a filter system 115 for removing the gaseous and particulate fluoride from the process gases. A dedicated variable speed exhaust fan 116 creates sufficient underpressure within the superstructure 104 of the electrolytic cell 106 to entrain a scrubbed process gas mixture 118 and ambient air drawn into the electrolytic cell 106 through an adjustable fluid passage 136. An adjustable fluid passage 136 is positioned between each pair of a plurality of frames 138 supporting the electrolytic cell 106 to i) focus modulated cooling on the electrolytic cell 106 side walls at the cryolitic bath/metal pad interface; and ii) direct the waste heat from the electrolytic cell 106 side walls inside the electrolytic cell 106. The scrubbed process gas mixture 118 discharged from the exhaust fan 116 is conveyed by a dedicated scrubbed process gas duct 120 to an area under the pot-room roof gravity ventilator 122. The relatively hot scrubbed process gas mixture 118 then enters an inductor 124 and is thus, vented through the pot-room roof gravity ventilator 122 to an open environment outside the electrolytic cell 106 and pot-room 100 at a temperature greater than 125° C. and up to about 400° C. The inductor 124 inducts additional ventilation flow through the pot-room roof gravity ventilator 122 and increases the ambient air 128 drawn into the pot-room 100 through various designed openings. The emission plume 130 leaving the pot-room 100 includes the scrubbed process gas mixture 118 and ambient air 128. A deck 132 is attached at each side of the electrolytic cell 106 for accessing removable side covers 134.

Figure 2:
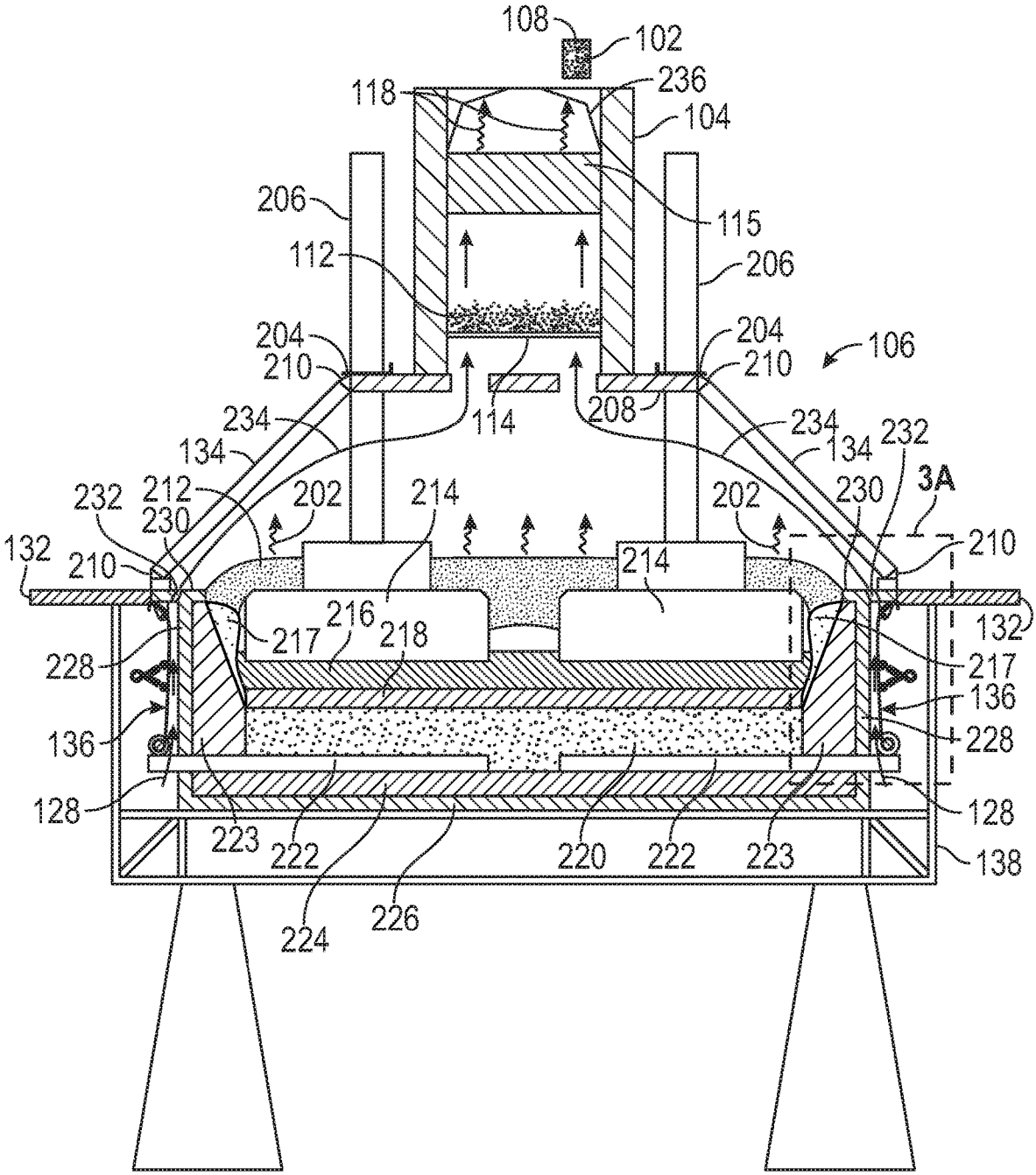
FIG. 2 is a cross-sectional view of the electrolytic cell along 2-2 in FIG. 1 illustrating the adjustable fluid passage.

Referring now to FIG. 2, a cross-sectional view of the electrolytic cell 106 along 2-2 in FIG. 1 illustrates the adjustable fluid passage 136. The level of the fresh alumina 102 initially deposited in the fluidized bed 112 is maintained by a fresh alumina feeder assembly 110 in FIG. 1, which releases the fresh alumina 102 from the fresh alumina conveyor 108 into the fluidized bed 112. The gas capture efficiency of the electrolytic cell 106 is improved by reducing the open area (gaps) in the electrolytic cell 106 through which process gases 202 are prone to escape as fugitive emissions. This may be accomplished using an anode stem seal 204 around each anode stem 206 where it passes through the gas skirt 208 and removable side cover seals 210. Additional seals may be used to reduce gaps around access doors. In this manner, the collection of process gases 202 produced by the smelting process in the electrolytic cell 106 and released through openings in the crust 212 is improved and the flow of ambient air 128 drawn into the electrolytic cell 106 through various gaps therein is significantly reduced. Likewise, the induction of ambient air 128 drawn into the electrolytic cell 106 through the adjustable fluid passage 136 is significantly increased. As a result, the temperature of the process gases 202 in the electrolytic cell 106 increases, indirectly causing the amount of gaseous fluoride in the process gases 202 to decrease.

The smelting process produces the process gases 202 through a chemical reaction. Carbon anodes 214 extend into an electrolyte comprising alumina dissolved in the molten cryolyte 216. A direct current, which may reach values of more than 500 kA, flows through the anodes 214 and the molten cryolyte 216 to produce a chemical reaction that reduces the alumina to a liquid aluminum metal 218 and heats the electrolyte by the Joule effect to a nominal operating temperature of approximately 960° C. The electrolytic cell 106 is fed regularly with fluorinated alumina to compensate for the alumina consumption resulting from the electrolysis induced, chemical reactions. The direct current is conducted through a cathode block 220 and is collected by cathode bars 222 embedded in the cathode block 220. The cathode bars 222 conduct the direct current from the electrolytic cell 106 to another electrolytic cell configured in series with the electrolytic cell 106. Thermal equilibrium depends predominately on the physical design parameters of the electrolytic cell 106 specifically, the dimensions and properties of the cathode side wall lining 223, crust 212 granulometry and thickness, and the operating conditions. The cell is operated to induce the stable formation of solidified cryolyte 217 on the internal side walls of the cathode sidewall lining 223. The solidified cryolyte 217 inhibits corrosion of the sidewall lining 223 by the molten cryolyte 216.

The electrolytic cell 106 includes a bottom 226, side walls 228 and corresponding deck plates 230, which may be collectively referred to as the pot shell. The plurality of frames 138 surround and support the pot shell, which contains the anodes 214, molten cryolyte 216, liquid aluminum metal 218, cathode block 220, cathode bars 222, sidewall lining 223 and insulation 224. The insulation 224 forms a thermal barrier between the cathode bars 222, cathode block 220 and the bottom 226 of the electrolytic cell 106 thus, minimizing heat loss to the pot-room 100. Each deck plate includes an opening 232 for the passage of ambient air 128 therethrough and into the electrolytic cell 106. Each removable side cover seal 210 is positioned between a removable side cover 134 and a respective deck plate 230. Each deck 132 may be positioned to rest on the plurality of frames 138 without being attached thereto.

In typical electrolytic cell operating conditions, ambient air 128 from the pot-room 100 will be inducted through an opening in the adjustable fluid passage 136. Induction is facilitated by suction from the variable speed exhaust fan 116 and each adjustable fluid passage 136. Heat is transferred from the side walls 228 to the ambient air 128 inducted into the adjustable fluid passage 136. Typically, a pressure of the ambient air 128 is greater than a pressure of the heated ambient air in the adjustable fluid passage 136. The heated ambient air passes through the opening 232 in each deck plate 230 and is mixed with the process gases 202. The process gas mixture 234 is inducted through slots in a gas skirt 208, openings in the porous floor 114 and the fluidized bed 112. The process gas mixture 234 is further inducted through the filter system 115 before releasing the scrubbed process gas mixture 118 through a plenum 236 that is connected to the variable speed exhaust fan 116 in FIG. 1. The variable speed exhaust fan 116 and/or the adjustable fluid passage 136 can be adjusted to control and modulate the induction rate of the ambient air 128 through each adjustable fluid passage 136 and the heat transferred from the side walls 228 to the ambient air 128 inducted into each adjustable fluid passage 136. As a result, the amount of gaseous fluoride in the process gases 202 indirectly decreases because the source of moisture (hydrogen) entering the electrolytic cell 106 forming gaseous fluoride through thermal hydrolysis is reduced as the temperature increases in the electrolytic cell 106.

Figure 3A:
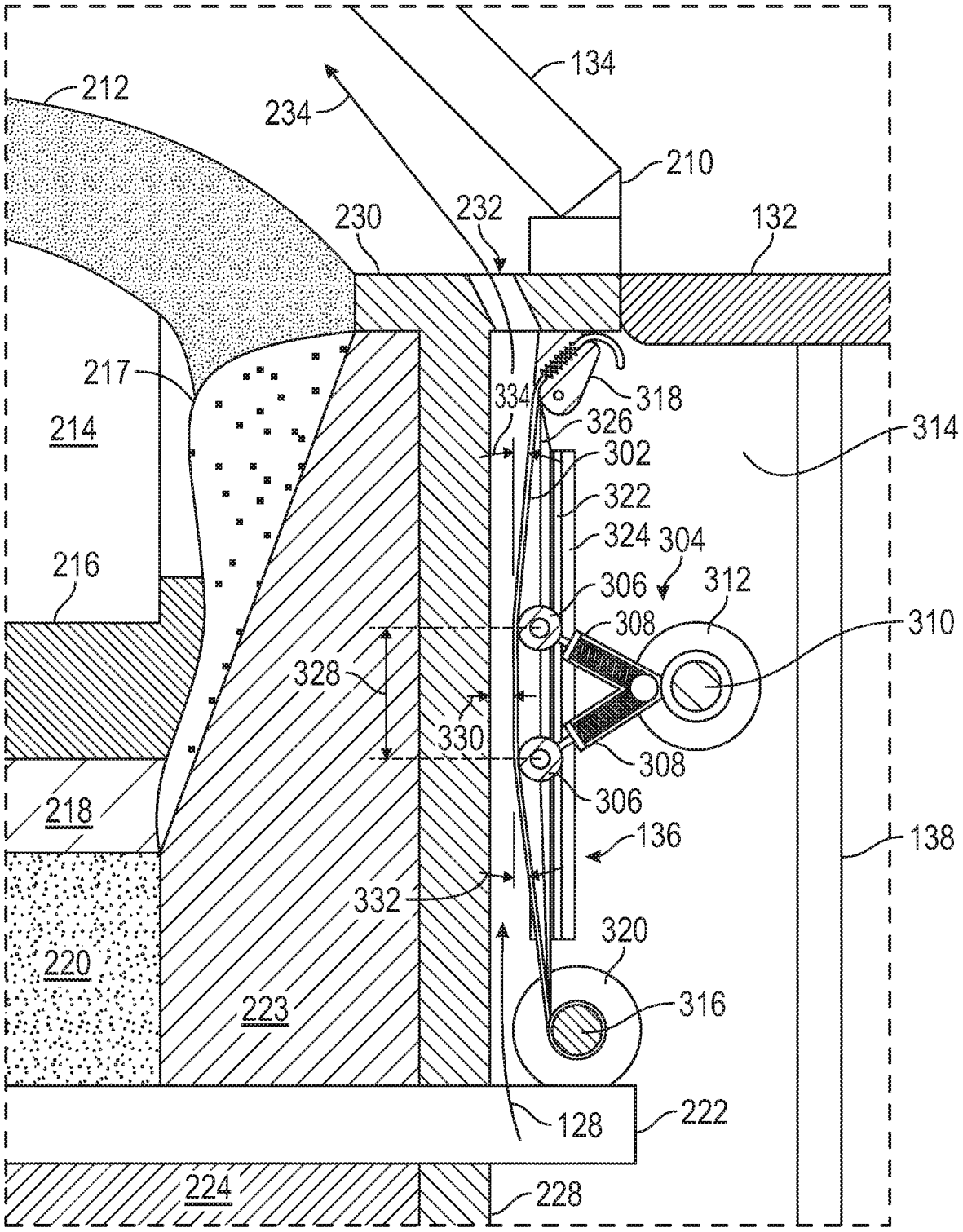
FIG. 3A is an enlarged view of the electrolytic cell within 3A of FIG. 2 illustrating the adjustable fluid passage.
Figure 3B:
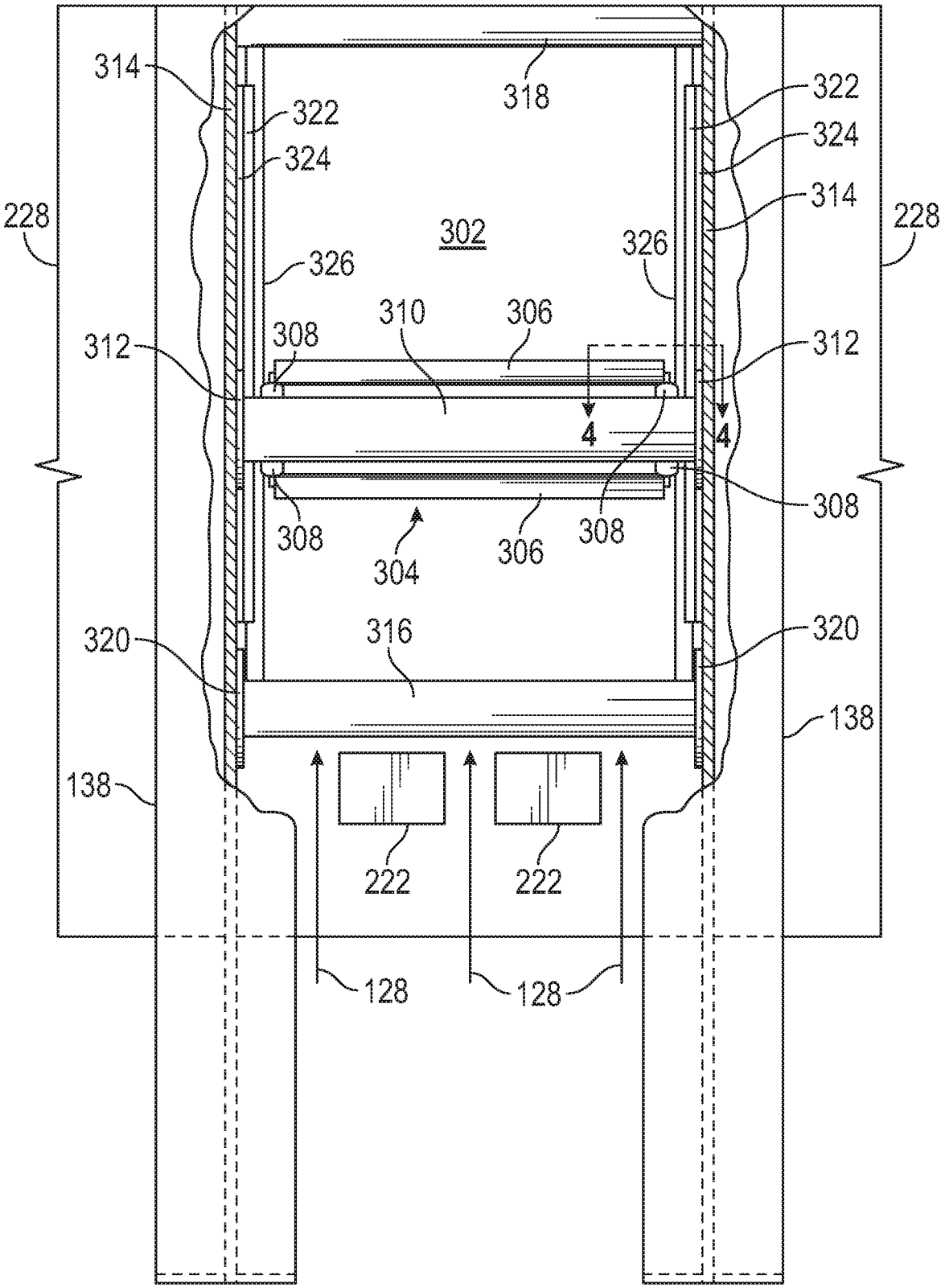
FIG. 3B is a front elevational view of the adjustable fluid passage in FIG. 3A.

Referring now to FIG. 3A, an enlarged view of the electrolytic cell within 3A of FIG. 2 illustrates the adjustable fluid passage 136. And, FIG. 3B is a front elevational view of the adjustable fluid passage 136 in FIG. 3A. The adjustable fluid passage 136 includes a flexible member 302, which is secured between a pair of the plurality of frames 138 supporting the electrolytic cell 106, and a biasing assembly 304 secured between the pair of frames 138. In one embodiment, the flexible member 302 may be made from aluminum however, in other embodiments the flexible member 302 might be made from other materials provided it remains flexible, has a highly reflective surface, is non-combustible up to a temperature of 600° C. and is substantially impermeable. An adjustable fluid passage 136 is thus, formed between the flexible member 302, a portion of the pair of frames 138 and a portion of the side wall 228 of the electrolytic cell 106. One end of the adjustable fluid passage 136 is open to ambient air 128 outside the electrolytic cell 106 and another end of the adjustable fluid passage 136 is open to process gases 202 inside the electrolytic cell 106 through the opening 232 in the deck plate 230. In other embodiments, however, another end of the adjustable fluid passage 136 may be open to process gases 202 inside the electrolytic cell 106 through an opening in another part of the electrolytic cell 106. The biasing assembly 304 is positioned outside the adjustable fluid passage 136 in contact with the flexible member 302.

The biasing assembly 304 includes at least a pair of tubular rollers 306 in contact with the flexible member 302 and a plurality of adjustable roller arms 308. Each adjustable roller arm 308 is secured to a respective end of a respective tubular roller 306. The biasing assembly 304 also includes a roller arm support member 310 that is secured at each end to a respective base 312 by means well-known in the art, which is attached to a side wall 314 of a respective frame 138. Each base 312 may be attached to a side wall 314 by means well-known in the art or by using magnets. Each adjustable roller arm 308 is secured to the roller arm support member 310. Each adjustable roller arm 308 may be adjusted by at least one of pneumatic, electric, hydraulic and mechanical means. Each adjustable roller arm 308 therefore, maintains a constant or variable, predetermined, force against the flexible member 302 through the respective tubular roller 306 to which it is secured. Each tubular roller 306 preferably contacts the flexible member 302 along a maximum obtainable distance between each side edge of the flexible member 302.

The flexible member 302 is secured at one end to a tensioner 316 and is secured within a clamp 318 at another end. The clamp 318 is attached at each end to a side wall 314 of a respective frame 138 by means well-known in the art or by using magnets. The tensioner 316 is attached at each end to a respective base 320 by means well-known in the art, which is attached to a side wall 314 of a respective frame 138. Each base 320 may be attached to a side wall 314 by means well-known in the art or by using magnets. The tensioner 316 may include a slot for receipt of the flexible member 302 that secures the flexible member 302 as it is wrapped around the tensioner 316. The tensioner 316 therefore, may be used to adjust a tension setting for the flexible member 302, which provides a variable force against the pair of tubular rollers 306. In another embodiment, the tensioner 316 may be replaced with another clamp like clamp 318. In this embodiment, the flexible member 302 is installed at a predetermined tension setting that provides a constant force against the pair of tubular rollers 306. Each side edge of the flexible member 302 is secured within a respective clamp 322. Each clamp 322 is attached to a respective base 324 by means well-known in the art, which is attached to a side wall 314 of a respective frame 138. Each base 324 may be attached to a side wall 314 by means well-known in the art or by using magnets. The flexible member 302 includes one or more folds 326 adjacent each clamp 322 securing a respective side edge of the flexible member 302. The one or more folds 326 allow the flexible member 302 to expand and contract in response to forces (ambient air 128 induction rate and/or flexible member 320 tension) opposing the pair of tubular rollers 306. In other embodiments, the one or more folds 326 may not be required or may be replaced with creases or other means necessary to allow the flexible member 302 to expand and contract in response to forces opposing the pair of tubular rollers 306.

The adjustable fluid passage 136 includes a choke section with an adjustable length 328 and an adjustable gap 330. The adjustable length 328 represents a distance between the pair of tubular rollers 306 and the gap 330 represents a distance between the flexible member 302 and the side wall 228 of the electrolytic cell 106. A portion of the side wall 228 forming part of the choke section represents a preferred area of the side wall 228 for controlling heat loss. The adjustable fluid passage 136 also includes an inlet angle 332 and an outlet angle 334, which may be the same or different. In one embodiment, the inlet angle 332 and an outlet angle 334 may be less than 45° relative to the side wall 228. In other embodiments, the inlet angle 332 and an outlet angle 334 may be greater than or equal to 45° relative to the side wall 228.

Figure 4:
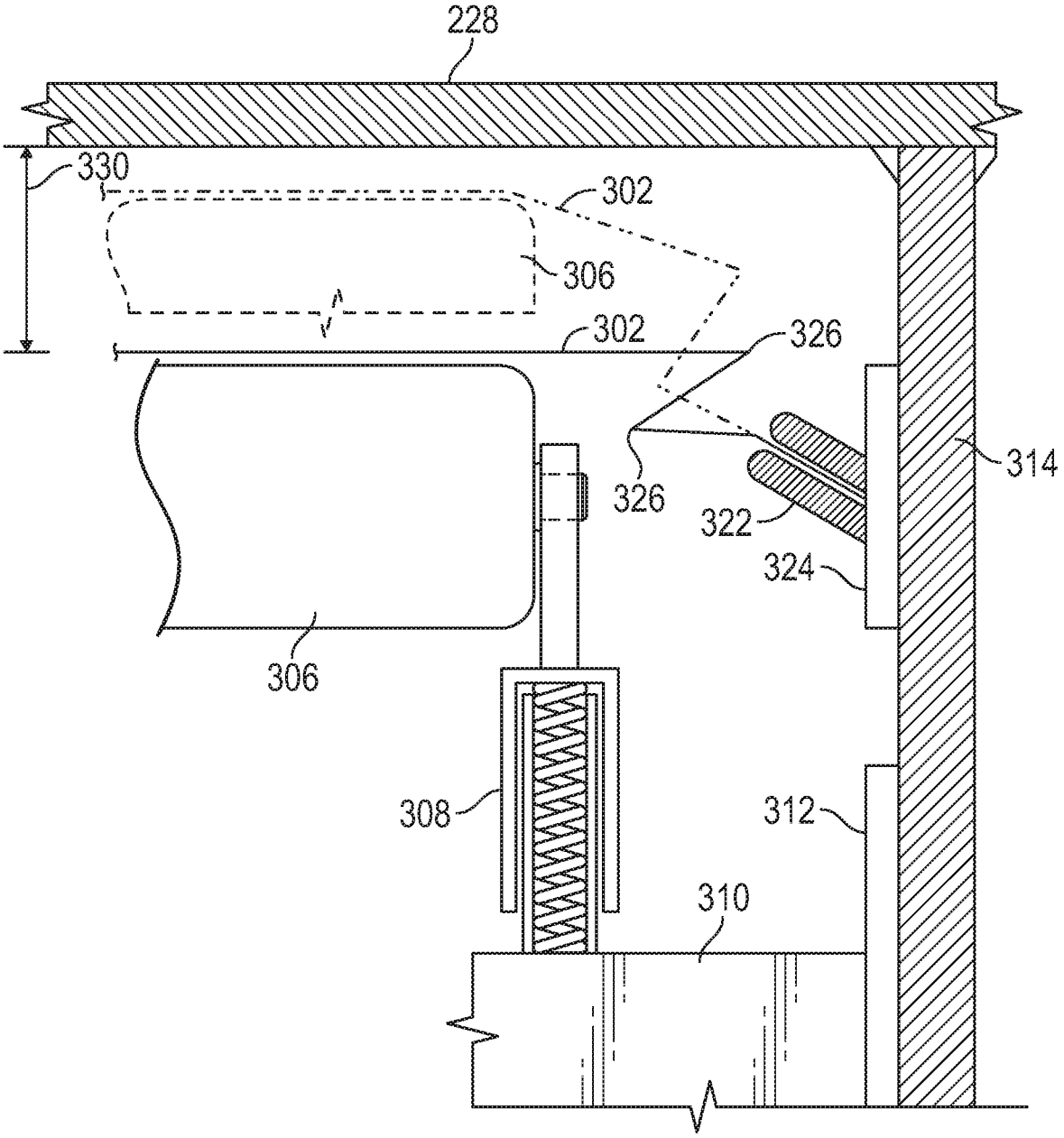
FIG. 4 is a top view of the adjustable fluid passage along 4-4 in FIG. 3B.

Referring now to FIGS. 3A-3B and FIG. 4, the operation of the adjustable fluid passage 136 is illustrated. A top view of the adjustable fluid passage 136 along 4-4 in FIG. 3B is illustrated in FIG. 4. Ambient air 128 is inducted from outside the electrolytic cell 106 into the adjustable fluid passage 136 that is formed between the flexible member 302, a portion of the side wall 228 of the electrolytic cell 106 and a portion of the side wall 314 of each respective frame 138. Heat loss is controlled from the electrolytic cell 106 by transferring heat from the portion of the electrolytic cell side wall 228 to the ambient air in the fluid passage 136. The heated ambient air is then inducted from the fluid passage 136 into the electrolytic cell 106 where it is mixed with the process gases 202 (FIG. 2) and becomes a process gas mixture 234.

Heat loss from the electrolytic cell 106 is generally controlled to maintain a preferred thermal equilibrium—meaning heat dissipated by the electrolytic cell 106 is balanced by the heat produced in the electrolytic cell 106. Maintaining the preferred thermal equilibrium depends on the ability to control heat loss from a preferred area of each electrolytic cell side wall 228 during different current amperages in the electrolytic cell 106. The electrolysis current amperage may be modulated, for example, under different operating conditions depending on the electrical grid supply and demand. Modulating the current has a direct effect on the heat flux along the electrolytic cell sidewalls 228, which varies along the vertical surface of each electrolytic cell side wall 228. Due to this variance, heat loss may be controlled by adjusting at least one of the length 328 and the gap 330 of the choke section. During low current amperages, for example, reducing the length 328 and enlarging the gap 330 will decrease the heat transferred from the preferred area of each electrolytic cell side wall 228 to the ambient air 128 in the adjustable fluid passage 136. Conversely, during peak current amperages, extending the length 328 and reducing the gap 330 will increase the heat transferred from the preferred area of each electrolytic cell side wall 228 to the ambient air 128 in the adjustable fluid passage 136. During peak current amperages, the change in distance of the length 328 is preferably at least two times greater than the change in distance of the gap 330. Adjusting the length 328 of the choke section will cause the preferred area of each side wall 228, which is the portion of the side wall 228 forming part of the choke section, to increase or decrease. Because peak current amperage (heat flux) typically occurs at an interface between the molten cryolyte 216 and the liquid aluminum metal 218 in the electrolytic cell 106 behind the side wall 228, the preferred area may be increased to optimally control heat loss adjacent thereto. Adjusting the length 328 and the gap 330 of the choke section will also cause the inlet angle 332 and an outlet angle 334 to increase or decrease.

Adjusting the fluid passage 136 is thus, accomplished by adjusting the length 328 and/or the gap 330 of the choke section. This may be accomplished by adjusting a tension setting for the flexible member 302 and/or adjusting the induction of the heated ambient air into the electrolytic cell 106 via the fluid inlet 128. During low current amperages, for example, the heat transferred from the preferred area of each electrolytic cell side wall 228 to the ambient air 128 in the adjustable fluid passage 136 may be decreased by increasing the tension setting for the flexible member 302 and/or decreasing the induction of the heated ambient air into the electrolytic cell 106 via the fluid inlet 128. This is illustrated by the position of the tubular roller 306 and flexible member 302 in FIG. 4. In this position, the gap 330 is enlarged and the length 328 is reduced, which will decrease the heat transferred from the preferred area of each electrolytic cell side wall 228 to the ambient air 128 in the adjustable fluid passage 136. Conversely, during peak current amperages, the heat transferred from the preferred area of each electrolytic cell side wall 228 to the ambient air 128 in the adjustable fluid passage 136 may be increased by decreasing the tension setting for the flexible member 302 and/or increasing the induction of the heated ambient air into the electrolytic cell 106. This is illustrated by the phantom position of the tubular roller 306 and phantom flexible member 302 in FIG. 4. In this position, the gap 330 is reduced and the length 328 is extended, which will increase the heat transferred from the preferred area of each electrolytic cell side wall 228 to the ambient air 128 in the adjustable fluid passage 136. The one or more folds 326 allow the flexible member 302 to expand and contract in response to the ambient air 128 induction rate and/or flexible member 320 tension opposing the pair of tubular rollers 306.

The tensioner 316 may be used to adjust the tension setting for the flexible member 302, which provides a variable force against the pair of tubular rollers 306. As the tension setting increases, the length 328 is reduced and the gap 330 is enlarged. Conversely, the length 328 is extended and the gap 330 is reduced as the tension setting is decreased and the pair of tubular rollers 306 force the flexible member 302 toward the side wall 228. In another embodiment, the tensioner 316 may be replaced with another clamp like clamp 318. In this embodiment, the flexible member 302 is installed at a predetermined tension setting that provides a constant force against the pair of tubular rollers 306. In either embodiment, decreasing the induction of the heated ambient air into the electrolytic cell 106 will reduce the length 328 and enlarge the gap 330 due to the pressure of the ambient air 128 in the adjustable fluid passage 136 and the constant force of the flexible member 302 against the pair of tubular rollers 306. Conversely, increasing the induction of the heated ambient air into the electrolytic cell 106 will extend the length 328 and reduce the gap 330 due to the reduced pressure of the ambient air 128 in the adjustable fluid passage 136 and the induction pulling the flexible member 302 away from the pair of tubular rollers 306.

Figure 5B:
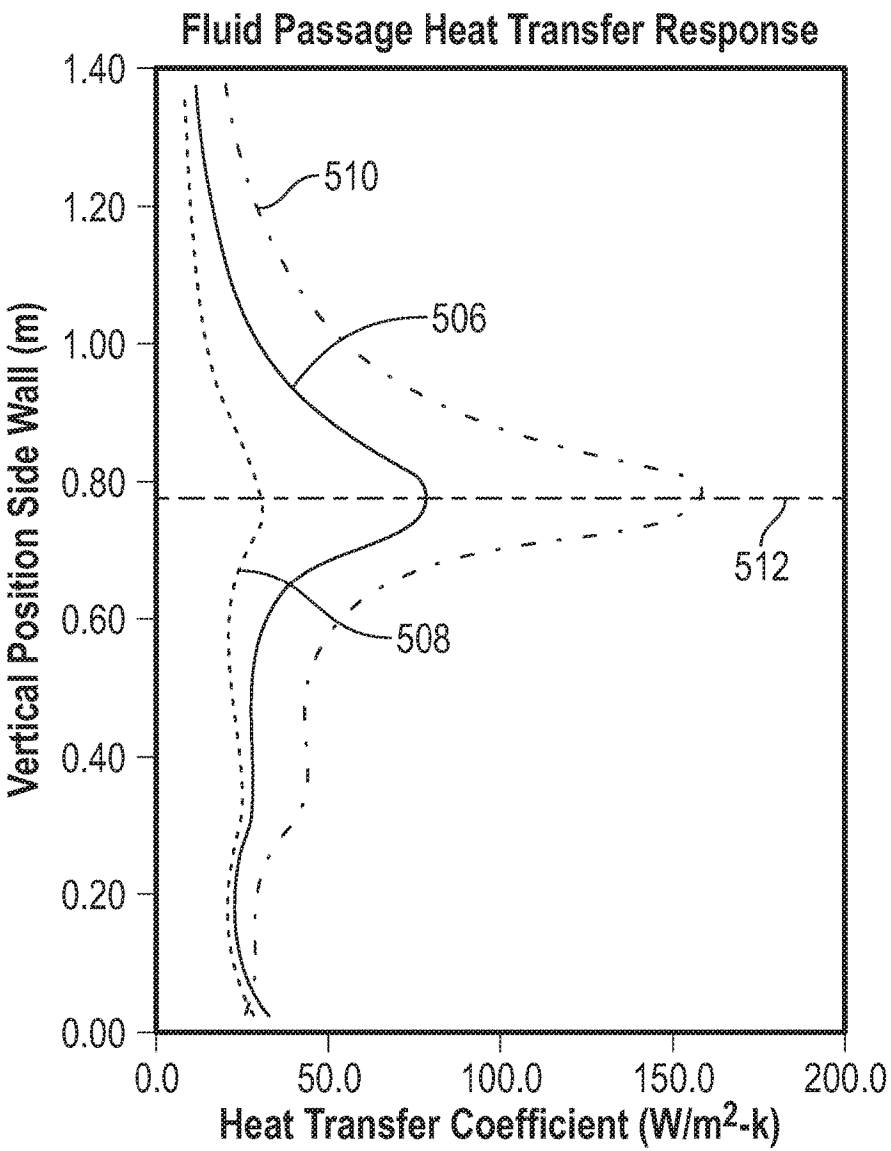
FIGS. 5A-5B are graphical displays illustrating the heat flux distribution and the corresponding heat transfer coefficient for the adjustable fluid passage along the sidewall during different operating conditions in the electrolytic cell.
Figure 5A:
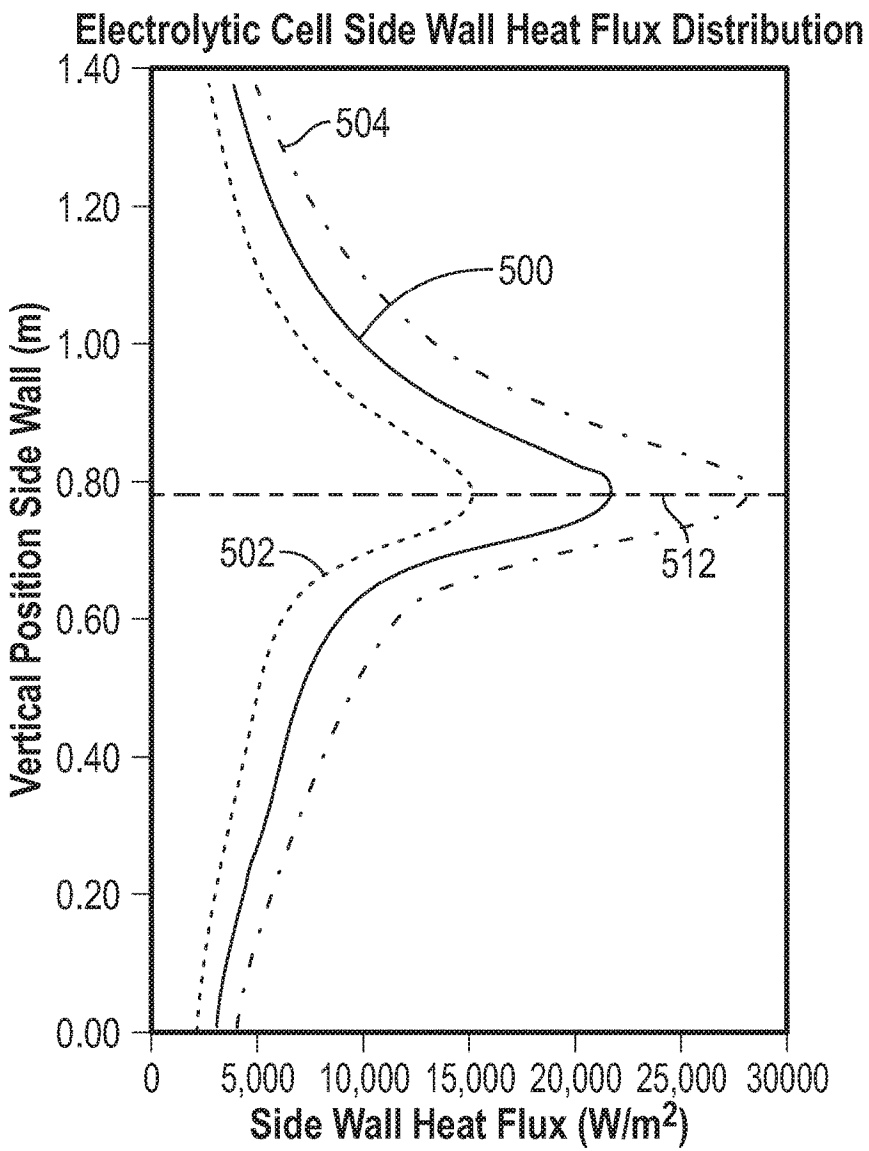

Referring now to FIGS. 5A-5B, the graphical displays illustrate a conventional heat flux distribution (5A) that is well-known in the art for an electrolytic cell and the corresponding calculated (anticipated) heat transfer coefficient (5B) for the adjustable fluid passage along the sidewall during different operating conditions in the electrolytic cell.

The electrolytic cell 106 peak heat flux while operating under thermal equilibrium typically occurs at the molten electrolyte—molten metal interface 512 where the electrical ohmic resistance (and resulting heat generation) is greatest between the anodes and top of the cathode blocks. An electrolytic cell 106 operating at its design current amperage, herein referred to as the Normal 100% condition, would typically generate a side wall heat flux distribution 500 as illustrated in FIG. 5A. The corresponding heat loss from the side walls 228, as a result of the inducted ambient air 128 flowing through an adjustable fluid passage 136 with gap 330 and length 328 settings of 5 mm and 96 mm, respectively, is illustrated by the heat transfer coefficient curve 506 in FIG. 5B.

Maintaining a preferred thermal equilibrium under modulated electrolysis current amperage operating conditions depends on the ability to control heat loss from a preferred area of the electrolytic cell side walls 228. An electrolytic cell 106 operating at its minimum current amperage, herein referred to as the Minimum condition, would typically generate a side wall heat flux distribution 502 that can be more or less than 70% of the Normal 100% operating condition. The corresponding heat loss from the side walls 228, as a result of the inducted ambient air 128 flowing through an adjustable fluid passage 136 with gap 330 and length 328 settings of 28 mm and 50 mm, respectively, is illustrated by the heat transfer coefficient curve 508 in FIG. 5B. Alternatively, an electrolytic cell 106 operating at its maximum current amperage, herein referred to as the Maximum condition, would typically generate a side wall heat flux distribution 504 that can be more or less than 130% of the Normal 100% operating condition. The corresponding heat loss from the side walls 228, as a result of the ambient air 128 inducted through an adjustable fluid passage 136 with gap 330 and length 328 settings of 3 mm and 100 mm, respectively, is illustrated by the heat transfer coefficient curve 510 in FIG. 5B.

Per the calculations presented in FIG. 5B, a plurality of fluid passage adjustments is possible for maintaining a preferred thermal equilibrium under modulated electrolysis current amperage operating conditions. In addition, there is also a strong positive coefficient of correlation of no less than 0.8 between the inducted ambient air 128 through the adjustable fluid passage 136 and the temperature increase of the inducted ambient air 128. In conjunction, these two operating parameters, adjustable fluid passage 136 and the capability to broadly modulate the inducted ambient air 128 using a dedicated variable speed exhaust fan 116 for each fluid passage position, exceed the capabilities of the prior art to control heat loss from a preferred area of the electrolytic cell side walls during different current amperages in the electrolytic cell 106.

The adjustable fluid passage 136 thus, may be particularly useful when the electrolysis current amperage is modulated under different operating conditions depending on the electrical grid supply and demand. The adjustable fluid passage 136 can variably control (increase and decrease) heat loss from a preferred area of the electrolytic cell side walls 228 as a function of the preferred area. The adjustable fluid passage 136 can also direct the waste heat from the electrolytic cell side walls 228 back into the electrolytic cell 106, which improves the recovery efficiency of low grade waste heat, lowers the capital cost of the electrolytic cell 106, improves the electrolytic cell operating efficiency, and reduces personnel exposure to heat and dust emissions in work area. The adjustable fluid passage 136 should thus, provide an appreciable saving on the production cost of aluminum due to the reduced energy consumption by the electrolytic cell.

The adjustable fluid passage 136 may be used in conventional smelting process systems using injection type dry scrubbing and new integrated gas treatment (IGT) systems like that described in WO 2015/191022 (hereinafter referred to as the "IGT System"). The adjustable fluid passage 136 may also be retrofitted to preexisting conventional smelting process systems and the new IGT System. An IGT System using the adjustable fluid passage 136 has the potential for being applied to multiple aluminum greenfield, brownfield expansion and retrofit projects for traditional and non-traditional markets.

While the present disclosure has been described in connection with the illustrative embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A system for controlling heat loss from an electrolytic cell, which comprises;

a pair of frames supporting the electrolytic cell;

a flexible member secured between the pair of frames;

an adjustable fluid passage formed between the flexible member, a portion of the pair of frames and a portion of a side wall of the electrolytic cell, wherein the fluid passage includes a choke section with an adjustable length and an adjustable gap and one end of the fluid passage is open to ambient air outside the electrolytic cell and another end of the fluid passage is open to process gases inside the electrolytic cell; and a biasing assembly secured between the pair of frames outside the fluid passage and in contact with the flexible member.

2. The system of claim 1, wherein one end of the flexible member is secured to a tensioner positioned between the pair of frames and another end of the flexible member is secured within a clamp positioned between the pair of frames.

3. The system of claim 1, wherein a side edge of the flexible member is secured within a clamp attached to a side wall of one of the pair of frames and another side edge of the flexible member is secured within a clamp attached to a side wall of another one of the pair of frames.

4. The system of claim 3, wherein the flexible member includes one or more folds adjacent each clamp securing a respective side edge.

5. The system of claim 1, wherein the end of the fluid passage is open to the process gases inside the electrolytic cell through an opening in a deck plate of the electrolytic cell.

6. The system of claim 1, wherein the biasing assembly includes a pair of tubular rollers in contact with the flexible member, a plurality of adjustable roller arms, each roller arm secured to a respective end of a respective tubular roller and a roller arm support member secured to each roller arm.

7. The system of claim 6, wherein each adjustable roller arm is adjusted by at least one of pneumatic, electric, hydraulic and mechanical means.

8. The system of claim 6, wherein the pair of tubular rollers contact the flexible member along a maximum obtainable distance between each side edge of the flexible member.

9. The system of claim 1, wherein the length represents a distance between a pair of tubular rollers and the gap represents a distance between the flexible member and the electrolytic cell side wall.

10. The system of claim 9, wherein the fluid passage includes an inlet angle and an outlet angle.

11. The system of claim 10, wherein the inlet angle and the outlet angle are less than 45° relative to the electrolytic cell side wall.

12. The system of claim 1, wherein the choke section is positioned adjacent an interface between a molten cryolite bath and a molten metal pad in the electrolytic cell behind the side wall.

13. The system of claim 1, wherein a portion of the electrolytic cell side wall forming part of the choke section represents a preferred area of the electrolytic side wall for controlling heat loss.

14. The system of claim 1, wherein the flexible member is aluminum.

15. The system of claim 1, wherein a pressure of the ambient air outside the electrolytic cell is greater than a pressure of heated ambient air in the fluid passage.

* * * * *